United States Patent [19]

Slodzian et al.

[11] Patent Number: 4,638,160

[45] Date of Patent: Jan. 20, 1987

[54] HIGH CLARITY MASS SPECTROMETER CAPABLE OF MULTIPLE SIMULTANEOUS DETECTION

[75] Inventors: Georges Slodzian, Sceaux; Francois Costa De Beauregard, Paris; Bernard Daigne, Chatenay Malabry; Francois Girard, Paris, all of France

[73] Assignees: Office National d'Etudes et de Recherche Aerospatiales (ONERA), Chatillon; Universite de Paris-sud, Orsay, both of France

[21] Appl. No.: 695,240

[22] Filed: Jan. 28, 1985

[30] Foreign Application Priority Data

Jan. 27, 1984 [FR] France ..... 84 01332

[51] Int. Cl.[4] ..... H01J 49/32

[52] U.S. Cl. ..... 250/296; 250/396 R

[58] Field of Search ..... 250/296, 281, 282, 396 R, 250/294

[56] References Cited

U.S. PATENT DOCUMENTS 3,622,781 11/1971 Liebl ..... 250/296

4,389,571 6/1983 Crewe ..... 250/396 R 4,418,280 11/1983 Matsuda ..... 250/296

*Primary Examiner*—Bruce C. Anderson

*Assistant Examiner*—Jack I. Berman

*Attorney, Agent, or Firm*—Staas & Halsey

[57] ABSTRACT

Between the electrostatic sector (SE 23) and the magnetic sector (SM 30) of a mass spectrometer, there is provided a quadrupole (QP 26) which applies parallel beams to the magnetic sector whose inclination depends on the energy dispersion of the particles. A slotted lens (LF 27) corrects the divergence of the quadrupole in the perpendicular plane. A suitable relationship between the angle of the inlet face of the magnetic sector (SM 30) and the deflection angle provided thereby ensures that the second order aperture aberrations of the magnetic sector are corrected. The chromatic aberrations may be corrected by means of a hexapole (HP 25) centered on the focus of the quadrupole (QP 26). Another hexapole (HP 22) placed upstream from the electrostatic sector (SE 23) level with a constriction in vertical section of the particle beam serves to correct second order aperture aberrations related to the electrostatic sector (SE 23).

12 Claims, 14 Drawing Figures

HIGH CLARITY MASS SPECTROMETER CAPABLE OF MULTIPLE SIMULTANEOUS DETECTION

The invention relates to apparatus for separating charged particles, i.e. a mass spectrometer, having high clarity and for simultaneously identifying and measuring a plurality of elements.

The spectrometer is intended to receive a beam of charged particles or ions, composed by particles of different masses ($M=M_1$, $M_2$, $M_3$, etc), and moving with slightly different kinetic energies. Their average kinetic energy is noted V (eV) and the corresponding energy dispersing is noted $\pm\Delta V$.

BACKGROUND OF THE INVENTION

A mass spectrometer generally includes an inlet slot following which the beam passes through an electrostatic sector, and then a magnetic sector. The aim of this disposition is to deflect the particles in a manner which separates them as much as possible as a function of their masses, and which is as insensitive as possible to their kinetic energies. The deflection takes place in a "radial" plane which is the plane of symmetry of the instrument and which is perpendicular to the long direction of the inlet slot. The particle beam thus has a radial component and a perpendicular component in the so-called vertical section.

It is known to use a magnetic sector which possess an inlet face and an outlet face which are both planar, and in which the inlet face is inclined to the axis of the particle beam, while the plane of the outlet face passes through the intersection of the inlet face and the particle beam. Under these conditions, the deflection angle to the particles passing through the magnetic sector does not depend on the mass of the charged particles, thereby simplifying the system. The radius of curvature of the trajectories, however, does depend on the mass of the particles.

The quality of a mass spectrometer is defined by its separating power $M/\Delta M$, where $\Delta M$ is the smallest mass difference which can be distinguished by the instrument. In a spectrometer having perfect optics (the term "optics" is used in a broad sense here), this separating power would only depend on the size of the inlet slot. In reality, the images of the inlet slot, or "rays", are deformed by optical defects in the apparatus known as aberrations. These aberrations depend mainly on the energy dispersion $\Delta V$ of the ions, and on the aperture of the beam which is limited by the inlet slot, generally, the inlet plot is inserted prior to the magnetic sector.

For a given separating power, the best spectrometer is the most sensitive, i.e. the spectrometer which accepts the beam whose geometrical extent is the greatest. This aptitude of the spectrometer is called "clarity". However, for a given spectrometer geometry, the clarity can only be increased by reducing the undesirable effects of aberrations.

Finally, when it is desired to perform simultaneous measurements on all the rays of the spectrum (all the masses), the correction or elimination of aberrations is much more difficult.

The problem is thus one of providing a high clarity mass spectrometer capable of simultaneous multiple detection and which possesses a high separating power.

To this end, a first aim of the present invention is to correct the aberrations of the spectrometer, in particular of its magnetic sector, but also of its electrostatic sector.

A second aim of the present invention is to improve the matching and the transfer of the ion beam to the input of the spectrometer by means of transfer optics placed upstream from the mass spectrometer per se.

These aims are achieved by various aspects of the invention, some of which are of interest on their own account.

In known manner, the apparatus proposed herein comprises an inlet slot, followed by an electrostatic sector, and then a magnetic sector. An aperture slot may be inserted between the electrostatic and the magnetic sectors, or else, in conventional manner, at the inlet to the electrostatic sector. This assembly serves to deflect a particle beam in a radial plane perpendicular to the long dimension of the inlet slot. The magnetic sector has a planar inlet face which is inclined to the axis of the particle beam and an outlet face which is also plane and whose planar passes through the intersection of the inlet face and the particle beam. The planes in question are the effective magnetic faces which differ from the material faces because of the leakage fields.

Further, it is also known in a particular context, to interpose a quadrupole between the electrostatic and the magnetic sectors (see H. MATSUDA, MASS SPECTROMETRY REVIEWS, Vol. 2, No. 2 (1983) John Wiley, pages 289 to 325). However, this quadrupole operates very differently from that used by the present invention.

Finally, mass spectrographs of the "Mattauch-Herzog" type are also known, in which the aperture and the width of the energy band are respectively delimited by means of an aperture diaphragm and an "energy diaphragm" whose adjustments interact. The ranges over which the aperture may vary and over which the energy bandwidth may vary must be reduced to relatively small values if second order aberrations are to remain negligible. As a result, the transmission or clarity of the apparatus is small.

In French patent application published under No. 2 056 163, there is a proposal to transform a mass spectrograph of the Mattauch-Herzog type in such a manner as to enable independent adjustment of the aperture and of the energy bandwidth, and at the same time obtaining a greater value for the clarity of the apparatus.

The means proposed by this prior French document consists in disposing a first electric lens (18) between the inlet slot (10) and the energy diaphragm (20), and in disposing a second electric lens (22) between the energy diaphragm (20) and the magnetic sector (24). The specification gives details of the role of these lenses relative to the aperture diaphragm and to the adjustable energy diaphragm.

In one of the embodiments described by this specification the inlet face of the magnetic sector (24) is inclined at an angle $\epsilon$ which is equal to 26.6°. This use of an inclined inlet face, which is in itself well known, serves to define a focal point which is at a distance of twice the radius in a direction perpendicular to the plane of symmetry of the apparatus. The focus plane (26) is shifted behind the magnetic field through an angle w which is equal to 8.1° in this case.

The value of 26.6° for the angle $\epsilon$ corresponds to a standard deflection of 90° by the magnet. Naturally, a different value for the deflection angle would give rise to a different value for the angle $\epsilon$ in this prior document. This value of 26.6° is close to that described below in relation to the present invention, but for other reasons and using a magnetic sector receiving a particle beam which is parallel to the radial plane.

However, prior French patent application No. 2 056 163 uses "other way" focusing: whereas in a normal mass spectrograph, the returning particles are lost, in this prior specification the lenses return them by preventing the beam from moving away. It thus appears that the inclination of the inlet face of the spectrograph is used in the prior document to tighten the beam and not to correct aberrations therein as is proposed by the present invention.

SUMMARY OF THE INVENTION

According to a first characteristic of the present invention, the spectrometer includes means such as a quadrupole for supplying the magnetic sector with a beam of particles which is parallel, at least in the radial plane, and which further presents, for each energy in a band $\pm\Delta V$, the appropriate inclination to ensure that the magnetic sector operates achromatically for all the rays of the mass spectrum. Further, using $\epsilon$ to denote the angle between the inlet face and the normal to the axis of the beam on the deflection side thereof, and using $\theta$ to denote the deflection angle of the beam in the magnetic sector, the following relationship between these two holds: $\tan(\theta/2)\cdot\tan(\theta-\epsilon)=2$.

This makes it possible to cancel second order aperture aberrations created by the magnetic sector for beam trajectories which are situated in the radial plane ($a^2$ aberrations where a is the inclination of a trajectory in the radial plane relative to the central trajectory). Naturally, cancellation of these aberrations also takes place for the radial components of trajectories which also include a vertical component. These trajectories in the vertical section (or components in the vertical section of any trajectories) also produce second order aperture aberrations in the radial plane ($b^2$ aberrations where b is the inclination of a trajectory relative to the radial plane).

A second characteristic of the invention makes use of transfer optics. The transfer optics are disposed in cooperation with the spectrometer per se in much a manner that the vertical section of the particle beam includes a constriction between the inlet slot and the electrostatic sector; then, a first hexapole is placed at this constriction in such a manner as to compensate the second order aperture aberrations created by the electrostatic sector for trajectories situated in the radial plane, i.e. $a^2$ aberrations, and for the radial component of the other trajectories. The chosen position for the hexapole ensures that it does not introduce $b^2$ aberrations from the aperture in the vertical section.

The second order aperture aberrations related to the electrostatic sector are calculable, since the sector may, for example, be of the spherical type.

Preferably, the transfer optics is disposed to apply to the inlet slot a beam of particles which is substantially parallel in the vertical plane. A converging lens is provided between the inlet slot and the first hexapole (this converging lens being capable of providing post-acceleration). The hexapole is centered on the conjugate point of the inlet slot via the said converging lens, in the vertical section of the beam.

According to another aspect of the invention, the transfer optics includes two electrostatic lenses, which co-operate to provide a constriction in the beam in the radial plane at the inlet slot. A slotted lens is provided between these two electrostatic lenses in such a manner as to ensure that the vertical section of the beam is parallel at the inlet slot. In this case, it is the converging (or post-acceleration) lens which causes the beam to converge at the above-mentioned constriction point in the vertical section.

The above relates to correcting aperture aberrations for trajectories situated in the radial plane in the magnetic sector and in the electrostatic sector. For the trajectories (or components of trajectories) in the vertical section, there is no $b^2$ aperture aberration correction. However, the transfer optics are disposed in such a manner that the b angles seen by the spectrometer are always very small, such that the corresponding $b^2$ aberrations are always very small, such that the corresponding $b^2$ aberrations are negligible.

Yet another aspect of the invention relates to correcting chromatic aberrations, i.e. energy dispersions.

The electrostatic sector and the magnetic sector both possess respective centers of virtual chromatic rotation, the quadrupole is placed in such a manner as to conjugate, with suitable magnification, the two centers of chromatic rotation. The quadrupole conjugates the center of chromatic rotation of the electrostatic sector with the center of chromatic rotation of the magnetic sector corresponding to a given radius, i.e. to a given mass. The quadrupole is in addition disposed in such a manner that each energy arrives at the magnetic sector with a suitable inclination. As a result, chromatic dispersion is completely cancelled for the mass concerned on leaving the magnetic sector while for other masses the chromatic dispersion cancels at their rays. This correction operates within the limits of the energy band $\pm\Delta V$ defined by means disposed upstream from the transfer optics or by a filter slot placed at P3.

In practice, the quadrupole is disposed in such a manner that its object focus coincides with the real image given by the electrostatic sector of the inlet slot in the radial plane, and the quadrupole is then followed by means for compensating its divergence in the vertical section such that the beam of particles is subsequently parallel in both transverse directions. The means for compensating the quadrupole divergence in the vertical section is advantageously, a slotted lens.

There remain combined aperture and chromatic aberrations. To compensate these, the device includes a second hexapole disposed after the electrostatic sector and substantially centered on the real image given by the electrostatic sector of the inlet slot in the radial plane.

This disposition serves to reduce combined aberrations for trajectories situated in the radial plane, together with exact compensation for one selected mass. For the other masses the aberration is considerably reduced.

Chromatic filtering, i.e. energy filtering, of the particle beam is performed upstream from the transfer optics in this case. In a variant, it may be performed at the second hexapole. In which case, the second hexapole comprises two hexapoles on either side of an energy filtering slot.

BRIEF DESCRIPTION OF THE DRAWINGS

An embodiment of the invention is described by way of example with reference to the accompanying drawings, in which.

DESCRIPTION OF THE PREFERRED EMBODIMENTS

As previously mentioned, the present invention relates to a charged particle separator, or mass spectrometer, for simultaneous multiple detection with a high degree of clarity.

Unlike mass spectrographs, which use a photographic plate as the final detector, mass spectrometers do not necessarily require their detection zone, i.e. the output focal surface of the magnetic sector, to be planar. However, this is the case in the spectrometer in accordance with the invention which is described initially in general terms with reference to FIGS. 1 and 2.

The spectrometer has transfer optics 1 at its input. The nature of the transfer optics may depend on the characteristics of the particle beam applied to the input or "point source" S. The transfer optics 1 ends at an inlet slot FE 20 which constitutes the inlet to the mass spectrometer per se.

Figure 1:
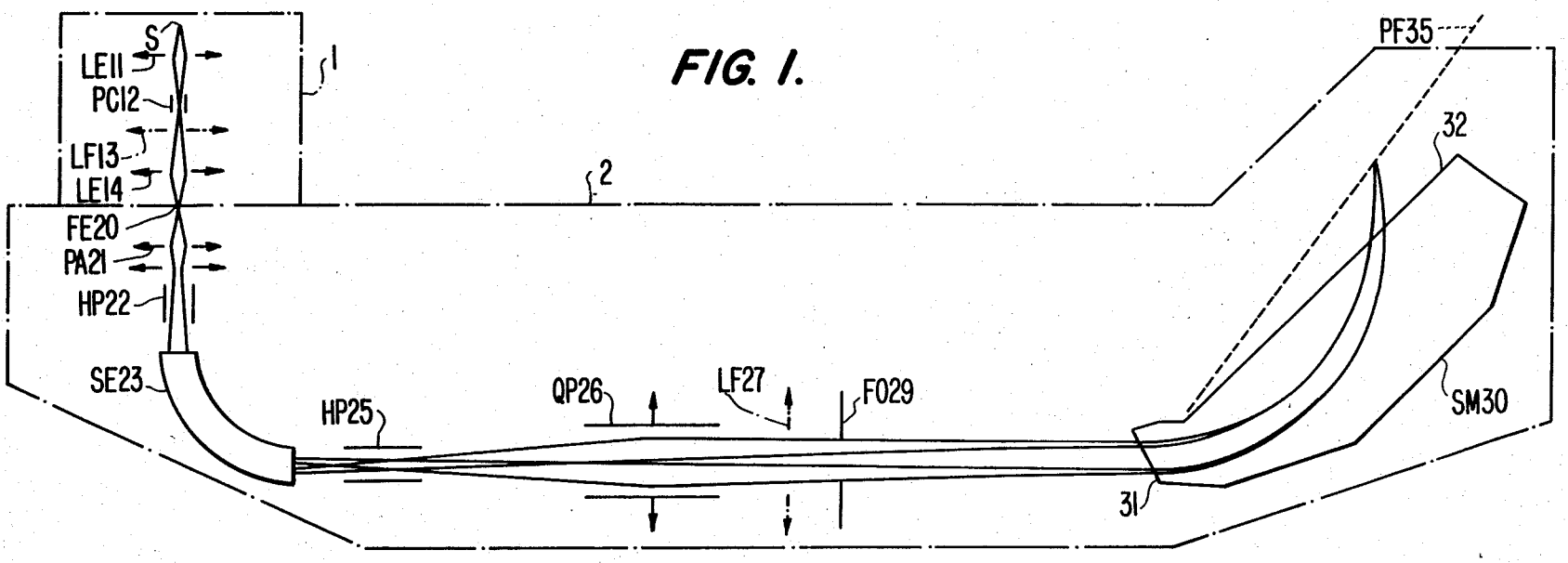
FIG. 1 is a first diagram of a spectrometer in accordance with the invention shown in section in the radial plane, this figure includes two parallel beams arriving at different incidences at the magnetic sector, said beams corresponding to slightly different energies separated by $\pm\Delta V$.
Figure 2A:
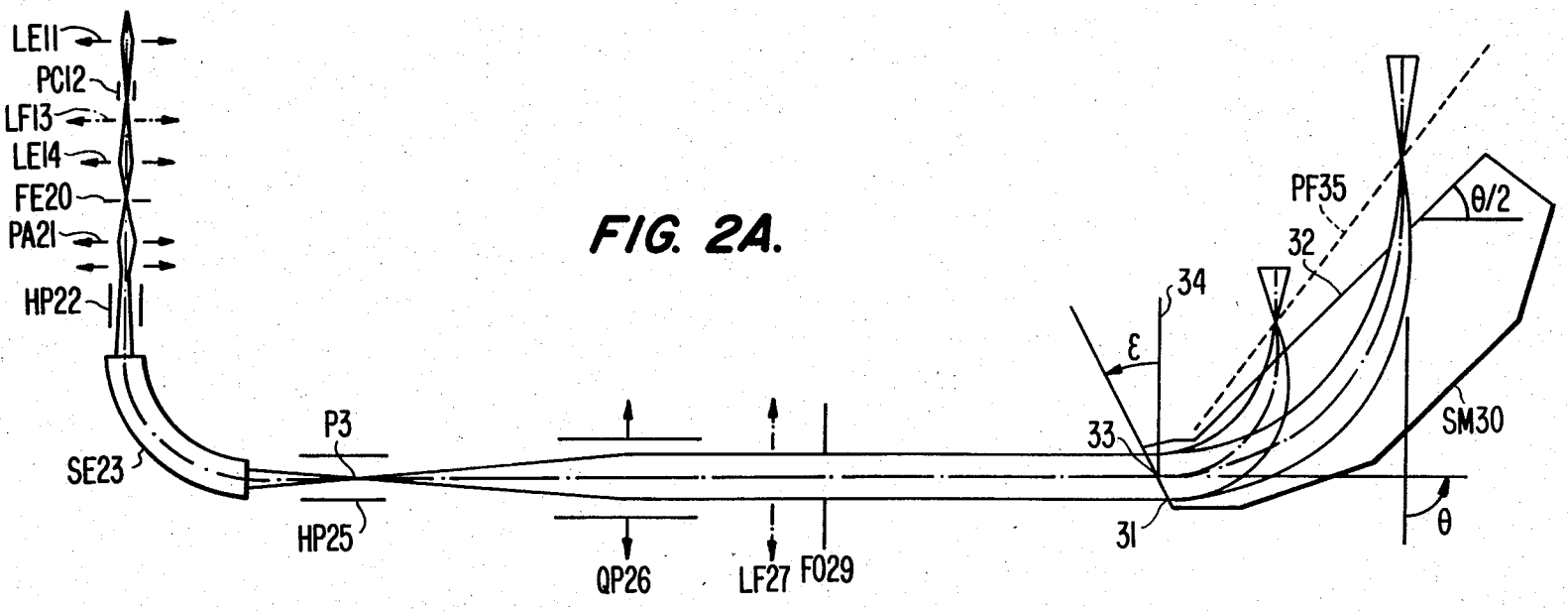
FIG. 2A is a similar view to FIG. 1, but showing how particles of different masses are separated in a single energy beam.
Figure 2B:
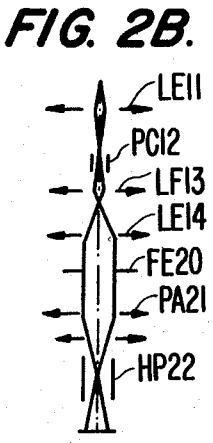
FIG. 2B is a view of a portion of the beam in vertical section showing the shape of the beam upstream from the electrostatic sector SE 23 FIG. 2A.

In known manner, the spectrometer includes, after the inlet slot FE20, an electrostatic sector SE 23, and then a magnetic sector SM 30, with an aperture slot FO 29 provided upstream from the magnetic sector. This set of means serves to deflect the particle beam in a radial plane perpendicular to the long dimension of the inlet slot FE 20. FIGS. 1 and 2A are sections in the radial plane.

It is known that the main component of a mass spectrometer is its magnetic sector whose dispersive action depends both on the mass and on the energy of each particle. This dispersive action is manifested by trajectories in the form of circular arcs of greater or smaller radius depending on the mass and on the energy. It is known to associate such a magnetic sector with a preceding electrostatic sector which also has a dispersive action but only as a function of the energy of the particles. The two sectors are combined in such a manner that the dispersive action of the electrostatic sector compensates the dispersive action of the magnetic sector which is due to energy. Thus, in theory, the dispersive action manifest at the output from the magnetic sector is a function of mass only.

Further, although not widely known, the above-mentioned Matsuda publication shows the use of a quadrupole between the electrostatic sector and the magnetic sector. This is thus also considered as being known, but it is pointed out that the Matsuda quadrupole has a function which is different from that used in the present invention.

Finally, it is also known to arrange for the magnetic sector SM30 to have a planar inlet face 31 which is inclined to the particle beam axis, and an outlet face 32 which are also plane and whose planar passes through the intersection 33 of the inlet face 31 and the axis of the particle beam. This disposition has the advantage of providing the same angle of deviation for all masses. The angle of deviation is equal to twice the angle between the outlet face 32 and the axis of the particle beam at the inlet to the magnetic sector SM 30. A further result is that for inlet beams which are parallel, the particles at the outlet from the magnetic sector are focused in a plane PF 35 which also passes through the point 33.

To obtain a spectrometer providing multiple detection and great clarity, together with high separating power (for excellent resolution), it is necessary to compensate the various aberrations which occur in the various components of the spectrometer taken singly or in combination.

A first aberration is known as a second order aperture aberration of the magnetic sector. Briefly, this type of aberration lies in two trajectories which are symmetrically disposed on either side of the central trajectory at the inlet to the magnetic sector and cross each other after the sector at a point which lies off the central trajectory. The offset between the point of intersection and the central trajectory is proportional to the square of the angular inclination of each of the secant trajectories relative to the central trajectory (whence the $a^2$ second order).

A first aspect of the invention consists in correcting this type of second order aperture aberration in the magnetic sector itself. Reference numeral 34 designates the normal to the axis of the particle beam situated on the concave side of the beam as it goes through the magnetic sector SM30. The symbol $\epsilon$ designates the angle formed between the inlet face 31 of the magnetic sector SM 30 and the normal 34. The symbol $\theta$ denotes the angle of beam deflection in the magnetic sector SM 30. In a completely surprising manner, it has been observed by the inventors that second order aperture aberrations created by the magnetic sector for trajectories situated in the radial plane are cancelled when these two angles satisfy the following equation:

$$\tan(\theta/2)\cdot\tan(\theta-\epsilon)=2.$$

The present invention concerns a mass spectrometer having very great clarity, i.e. an apparatus which accepts beams whose geometric extent is great, and also an apparatus which provides simultaneous detection which makes correcting aberrations very difficult.

The invention requires a suitable inclination of the inlet space to the magnetic sector so that it operates in a manner which is free from second order aperture aberrations for all masses (for all beam trajectories situated in the radial plane), providing the aperture aberrations of the electrostatic sector SE 25 are suitably cancelled beforehand.

The inclination $\epsilon$ of the inlet face as a function of the deflection angle $\theta$ through the magnetic sector is given by the above-mentioned equation:

$$\tan(\theta/2)\cdot\tan(\theta-\epsilon)=2.$$

For a deflection of 90° in the magnetic sector SM 30, $\tan\epsilon=\frac{1}{2}$, i.e. $\epsilon=25.56°$.

This equation is derived from work done by the applicants on the basis of aberration coefficients which apply to the magnetic sectors of numerous configurations. By combining some of these aberration coefficients, it was possible to deduce the above equation for which second order aperture aberrations in the magnetic sector are corrected. This is the main point which enables these aberrations to be corrected regardless of the geometrical extent of the beam, which is essential if the present invention is to make use of as wide, i.e., large a beam as possible.

Naturally, there remains a secondary effect that inclining the inlet face moves the focus plane (PF 35) of the magnet's magnetic field, which effect was previously known.

The above-mentioned published French patent specification No. 2 056 163 describes a magnetic sector whose inlet face is inclined at 26.6° for a deflection angle of 90°. However, this prior patent uses this disposition in a different context, and consequently it does not teach the person skilled in the art that the above-mentioned equation can be used to correct aberrations in the magnetic sector. In contrast, using the equation in accordance with the invention ensures that aperture aberrations of the magnet are corrected for trajectories situated in the radial plane, thus leaving only those aberrations which are due to the electrostatic sector and which can be corrected by means of a hexapole (HP 25) situated upstream from the magnetic sector.

The person skilled in the art will understand that this correction of second order aperture aberrations due to the magnetic sector itself is most important, and that it can naturally be applied to spectrometers other than that described in detail herein.

The particle beam available at the outlet from the electrostatic sector SE 23 has a constricion at a point P3 (FIG. 2A). In order to draw the best advantage from the first correction, means are provided downstream from this point P3 to ensure that the magnetic sector SM 30 receives a particle beam which is parallel in the radial plane. This may be achieved by means of one or more quadrupoles such as QP 26 interposed between the electrostatic sector SE 23 and the magnetic sector SM 30. One way of doing this consists in placing a single quadrupole QP 26 in such a manner that its object focus coincides with the point of constriction P3. As mentioned above, the position of the quadrupole QP 26 is determined in such a manner as the inclination of each of the parallel beams corresponding to the various energies is appropriate to achieve achromatic operation at the rays situated in the plane PF 35, and to achieve this operation simultaneously for all of the masses. This property is illustrated in FIG. 1 which shows that two parallel beams corresponding to energies $V+\Delta V$ come to a focus at the same point in the plan PF 35 (the transverse direction has been exaggerated to make the figure readable). As is shown below, the point P3 is the real image, given by the electrostatic sector SE 23, of the inlet FE 20 in the radial plane. Thus, FIG. 2A shows a parallel beam in the radial plane downstream from the quadrupole QP 26.

Figure 2C:
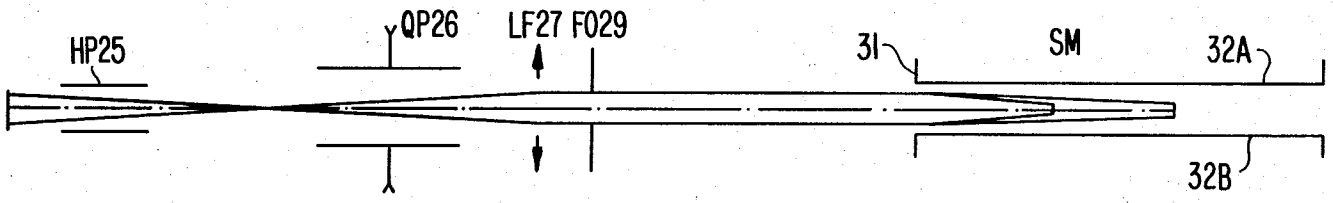
FIG. 2C is a view in vertical section showing the shape of the beam downstream from the electrostatic sector SE 23.

FIG. 2C shows that the quadrupole QP 26 has a diverging effect in the vertical section. This diverging action is in turn compensated by an electrostatic slotted lens LF 27. Downstream from the slotted lens LF 27 the beam is thus parallel and passes exactly through the small dimension of the aperture slot FO 29.

Returning to FIG. 2A, it can be seen that the parallel beam (shown as being single, and, in order to simplify the figure, as corresponding to the average energy of the beam) provided by the quadrupole QP 26 in the radial plane passes without modification through the slotted lens LF 27 so as to pass through the large dimension of the aperture slot FO 29. By comparing with FIG. 1, it can be seen that the large dimension of the aperture slot FO 29 enables parallel beams of various chromatic inclinations from the quadrupole QP 26 to pass therethrough, given the energy dispersion existing between the electrostatic sector SE 23 and the magnetic sector SM 30.

Finally, it can be seen from the above, that downstream from the slotted lens LF 27 the particle beam is parallel in both transverse dimensions, and that this continues until it is applied to the inlet face 31 of the magnetic sector SM 30.

It is known that both the electrostatic sector SE 23 and the magnetic sector SM 30 possess respective virtual centers of chromatic rotation. (The adjective "chromatic" is used in this context in relation to energy dispersion). The particles following the central trajectory prior to entering the electrostatic sector and having an energy which is slightly different from the nominal energy of the beam leave the electrostatic sector SE 23 on inclined trajectories. As the energy varies, these inclined trajectories appear to rotate about a point which is called the center of chromatic rotation.

In similar manner, the magnetic sector SM 30 possesses a center of chromatic rotation towards which particles having the same mass and similar energies converge with a suitable angle for them to end up after deflection at the same point in the focal plane PF 35 and with the same angle (the same trajectories) regardless of their energy in the band $\pm\Delta V$. This thus provides complete (first order) compensation of the energy dispersion of the magnetic prism. It may be observed that there are as many centers of chromatic rotation as there are masses under consideration.

However, if at the inlet to the magnetic sector SM 30, the inclination of the trajectories is simply proportional to the difference $\Delta V$ with some suitable factor, which is the same for all masses, they will still converge to the same point in the focal plane PF 35 for any given mass, but the trajectories of different energies will no longer have the same inclination.

According to another characteristic of the invention, means are provided for conjugating the respective centers of chromatic rotation of the electrostatic sector SE 23 and of the magnetic sector SM 30. The quadrupole QP 26 may be used to do this in a very simple manner with suitable magnification. This provides complete correction of chromatic (or energy) dispersion of the particle beam for one mass, and the quadrupole is in addition disposed so that the other masses follow trajectories of different energies with the appropriate inclinations.

We now examine the correction of second order aperture aberrations which occur in the electrostatic sector SE 23. This correction is based, for the most part, on a first hexapole HP 22. However, since this first hexapole HP 22 has close links with the performance of the spectrometer 2 per se and its transfer optics 1, it is appropriate here to describe the entire spectrometer.

Reference is made initially to FIGS. 1, 2A, 2B, 3A, and 3B to describe the transfer optics and the inlet to the spectrometer 2.

The beam of charged particles applied to the inlet of the transfer optics 1 has a constriction at the point S. This beam of ions is made up of particles of different masses which are moving with slightly different kinetic energies. As before, V denotes the average kinetic energy expressed in electron volts and $\pm\Delta V$ denotes the energy dispersion.

The beam is theoretically circularly symmetrical about the point S. Such a beam may be constituted by secondary ions emitted from a sample subjected to a beam of primary ions concentrated on its surface.

A first unipotential electrostatic lens LE 11 gives an image of the source point S at a point S1. Plates PC 12 may be provided around this point for recentering the beam, where necessary, on the optical axis.

Figure 3A:
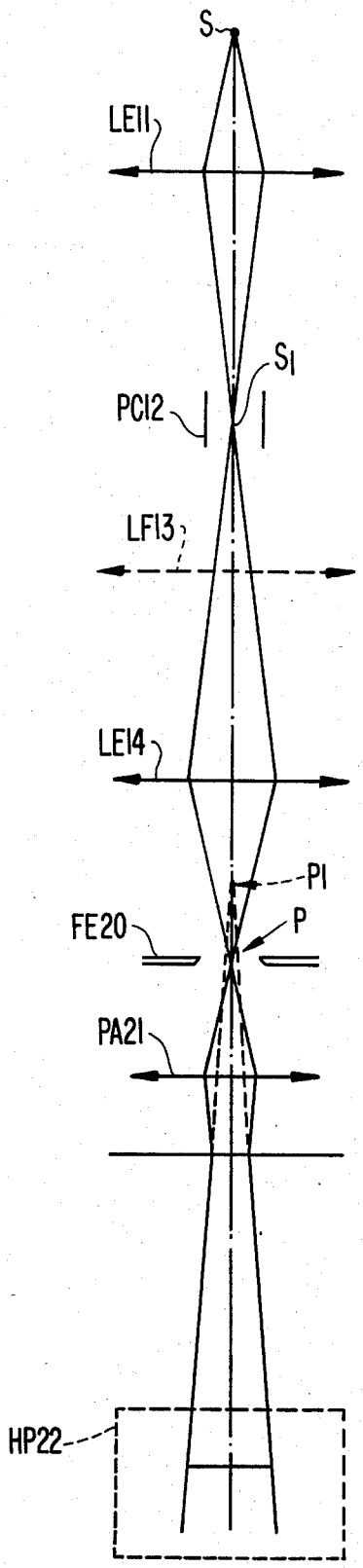
FIGS. 3A and 3B are enlarged views corresponding to FIGS. 2A and 2B, respectively.

After the first lens LE 11, and the optional centering plate PC 12, there is a slotted lens LF 13. FIGS. 2A and 3A show that this slotted lens has no effect on the trajectories of ions situated in the radial plane. However, in the vertical section (FIGS. 2B and 3B) the slotted lens LF 13 serves to converge the trajectories to a constriction point S2.

A second electrostatic lens LE 14 is placed after the slotted lens LF 13.

In the radial plane (FIGS. 2A and 3A), the lens LE 14 provides an image P of the point S and S1 at the inlet slot FE 20, which image is centered on the axis of the slot.

Figure 3B:
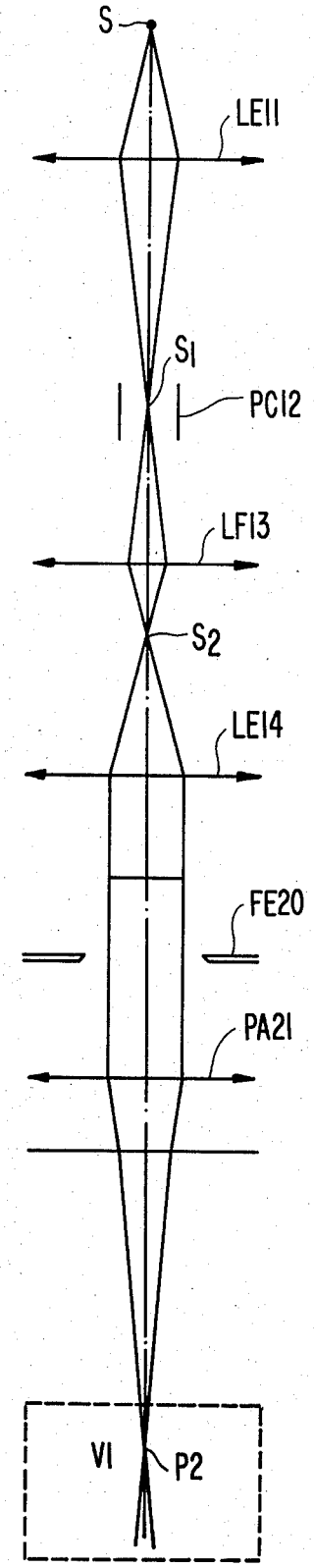

In the vertical section (FIGS. 2B and 3B), the lens LE 14 is placed in such a manner that its focus is substantially at the point S2, said lens thus providing rays or trajectories which are substantially parallel and which run over the length of the inlet slot FE 20 (FIG. 3B).

In this manner, the magnification at the inlet slot FE 20 in the radial plane is obtained by adjusting the excitation potentials of the electrostatic lenses LE 11 and LE14.

For the trajectories situated in the vertical plane (FIGS. 2B and 3B), independent adjustment is obtained by virtue of the slotted lens LF 13.

At the inlet to the spectrometer 2 per se, and after the inlet slot FE 20, there are provided, firstly, a converging electrostatic lens marked PA 21 for controlled post-acceleration, and, secondly, a first hexapole HP 22.

The lens PA 21 acts in the vertical section of the particle beam to produce a constriction in the beam at a point situated upstream from the electrostatic sector SE 23. The first hexapole HP 22 is centered on this constriction.

The hexapole HP 22 is arranged to compensate for second order aperture aberrations created by the electrostatic sector SE 23 for trajectories situated in the radial plane. It has no first order effect and thus does not modify the trajectories situated in the vertical section. However, as already mentioned, the hexapole avoids adding $b^2$ type aberrations on the trajectories in the vertical section due to the fact that the constriction of the beam in this section is located at the center of the hexapole.

The post-acceleration lens PA 21 performs another function. This function consists of modifying the aperture angle for the spectrometer 2 per se. Seen from the rest of the spectrometer, the constriction produce by the transfer optics at P level with the inlet slot in the radial plane, appears to move to P1 under the effect of the post-acceleration lens PA21. This serves to increase the clarity of the spectrometer after eliminating or correcting the major aberrations. Post-acceleration raises the ions from energy V to energy Vp.

In practice, the principal object plane of the post-acceleration lens PA 21 is situated in the plane of the inlet slot FE 20 so that the spectrometer sees an inlet slot situated at P1 in the main image plane of the lens PA 21. For the spectrometer, the size of the Gaussian image is unaltered. For a given separating power, only the available aperture angle at the inlet increases.

As mentioned before, the spectrometer is arranged so that the image focus of the post-acceleration lens PA 21 is situated at the center of the hexapole HP 22 at point P2.

In addition, the post-acceleration serves to reduce the relative energy dispersion from V/V to V/Vp, thereby reducing combined aberrations and aberrations in $(\Delta V/Vp)^2$.

For reasons of convenience, the Applicants have chosen the ratio V/Vp to be about one-fourth, which implies, for negative ions having an incident energy of $\pm 5$ kV, that all the conductors constituting the spectrometer and situated downstream from the post-acceleration lens PA 21 are at a voltage of $+15$ kV.

Thereafter, the spectrometer includes a second hexapole (HP 25) disposed after the electrostatic sector (SE 23) and centered on the real image given by the electrostatic sector (SE 23) of the slot (FE 20) in the radial plane. This serves to reduce combined aperture and chromatic aberrations for trajectories situated in he radial plane, with exact compensation for a selected mass. Since the hexapole HP 25 is centered on the point P3, it is possible to correct the combined aberrations without altering the adjustment of the hexapole HP 22 for correcting the aperture aberrations (i.e. the adjustments are independent).

In the embodiment described, energy filtering is performed upstream from the transfer optics.

In a variation, it could be performed at the second hexapole HP 25. In this case, the second hexapole would comprise two hexapoles on either side of an energy filtering slot (not shown).

After the second hexapole HP 25, there is the quadrupole QP 26, the slotted lens LF 27, the aperture slot FO 29 and finally the magnetic sector SM 30.

FIGS. 1, 2A, 2C and 2D show various details of the structure of the magnetic sector. The magnetic sector comprises a magnet (not shown) which co-operates with two pole pieces 32A and 32B whose shapes are shown by the figures in the radial plane.

Independently from obtaining the various corrections already described, the invention considerably facilitates the corrections by enabling them to be performed by adjustments which do not require the components of the spectrometer to be moved, which adjustments are made as independent as possible from one another.

Figure 4A:
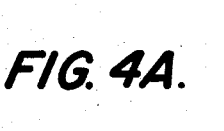
FIGS. 4, 4A and 4B show a particular embodiment of the spectrometer in accordance with the invention in greater detail.
Figure 4B:
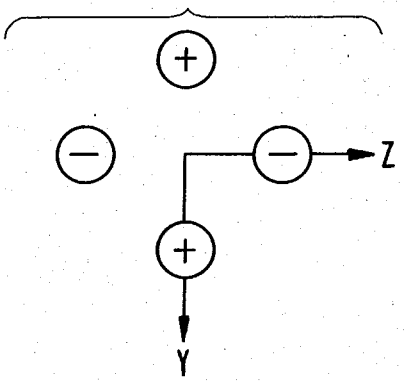
Figure 2D:
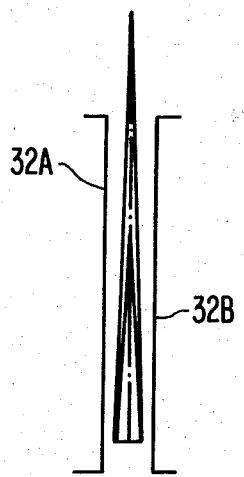
FIG. 2D is a view in vertical section showing the shape of the beam as it leaves the magnetic sector SM 30.

To this end, the assembly and adjustment of the spectrometer takes place as follows:

Initially the electrostatic sector SE 23 which is of the spherical type and the magnetic sector SM30 are put in place;

Then the quadrupole QP 26 is put in place so as to respect a priori the inclination condition appropriate to the chromatic trajectories and the parallelism condition of the beam entering the magnetic sector. The slotted lens LF 27 is then placed in such a manner as to correct the divergence of the quadrupole QP 26 in the vertical section. The aperture slot FO 29 is then placed as is the second hexapole HP 25 which is based at the focus of the quadrupole QP 26. It should be observed that the structure in right cross-section of the hexapoles HP 22 and HP 25 is illustrated in FIG. 4A, while the structure in right cross-section of the quadrupole QP 26 is illustrated in FIG. 4B;

Upstream from the electrostatic sector SE 23, the hexapole HP 22 is placed centered on the point chosen in advance as the focal point for the vertical section, then the post-acceleration lens PA 21, the inlet slot FE 20, the second electrostatic lens LE 14, the slotted lens LF 13, the centering plates PC 12 and finally the first unipotential electrostatic lens LE 11 are put in place.

All the components may thus be put in place in predetermined fixed positions which do not require subsequent modifications.

Additional adjustments are then performed as follows:

The quadrupole QP 26 is adjusted so as to give the appropriate inclination to the energy dispersed trajectories coming from the electrostatic sector SE 23;

The post-acceleration lens and the adjacent components are adjusted so as to bring the constriction point P3 to the focus of the quadrupole QP 26 and consequently to the center of the hexapole HP 25, this adjustment ensures that the beam from the quadrupole QP 26 is parallel in the radial plane and serves to compensate any defects in the positioning of the quadrupole QP 26; and The slotted lens LF 13 of the transfer optics 1 is adjusted to bring the constriction point P2 to the center of the first hexapole HP 22.

The person skilled in the art will understand that the apparatus is thus completely adjusted without there being any requirement for disassembly to vary the relative positions of its various constituent parts.

Nor is there any necessity for adjustments concerning the collection of deflected particles at the outlet from the magnetic sector SM 30. The particles of various masses all arrive in the same plane PS 35.

The particle separator in accordance with the invention can be used, like a spectrograph, with a photographic plate for collecting the deflected particles after being separated as a function of their masses.

In accordance with the invention, it is considered preferable to place a series of separate collector devices in the focal plane PF 35, such devices being electron multipliers, for example, having inlet surfaces which are sensitive to the impact of charged particles coming from the magnetic sector SM 30.

Figure 4:
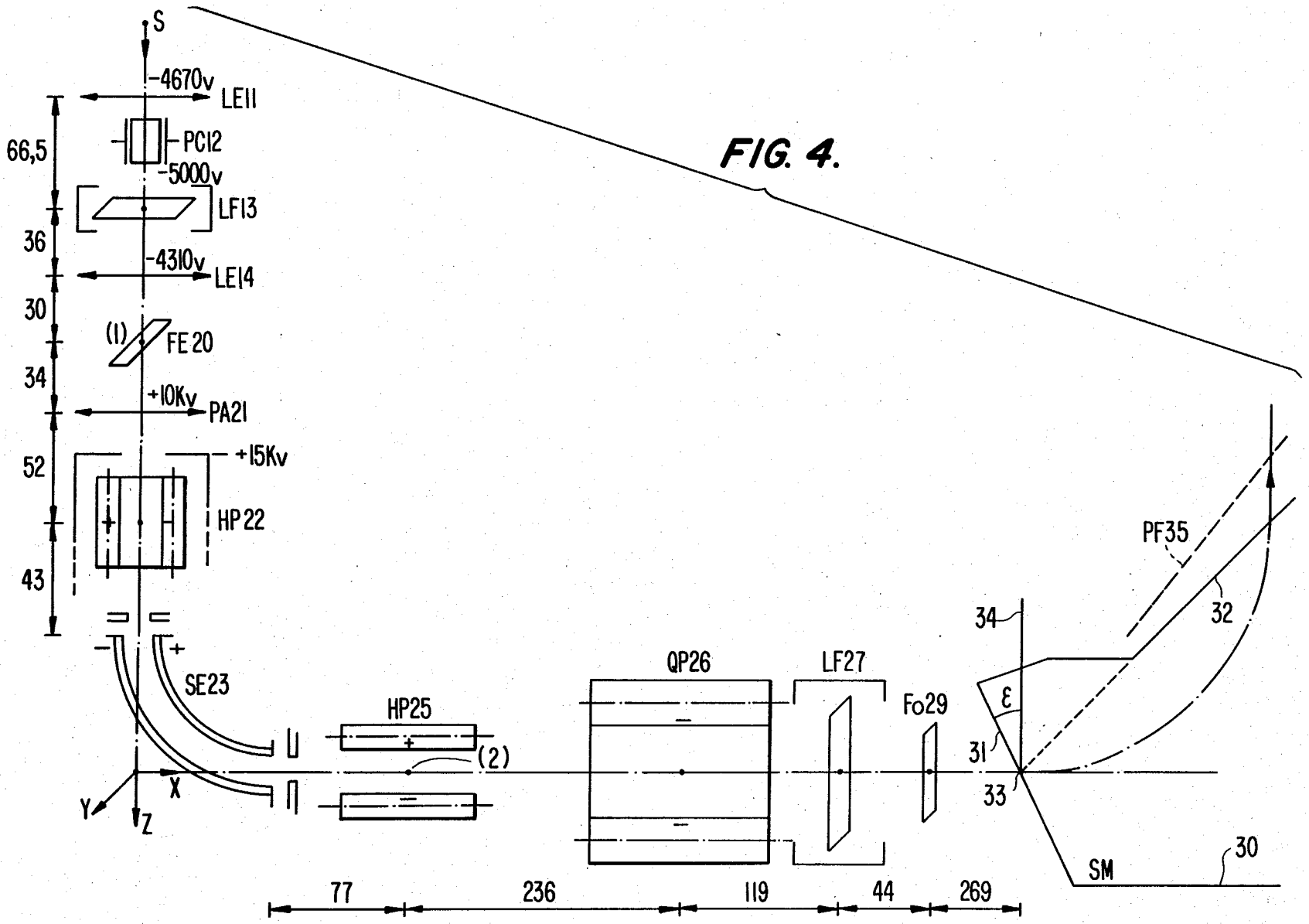

There follows a description made essentially with reference to FIG. 4 et seq. of a particular example of an embodiment of the invention.

Inlet beam. Negative ions having an average energy of 5 kV and constituting a circularly symmetrical beam have a constriction at the point S. The half-angle at the apex is about $10^{-2}$ radians to give a separating power $M/\Delta M$ of about 4,000.

Transfer optics 1. Electrostatic lens LE 11: three circular electrodes having a central hole with a diameter of 4 mm. The central electrode is at a potential of −4,670 volts. The other two electrodes situated on either side thereof are at ground potential.

Centering plates PC 12: four stainless steel plates having an active area 18×2 mm, are mounted to constitute a square channel. The distance between two facing plates is 3 mm. Their centers are placed level with a constriction in the ion beam.

The slotted lens LF 13: three electrodes having rectangular openings with a long axis situated in the radial plane. The central electrode: 6×64 mm; the other two electrodes: 4×30 mm. The central electrode which receives a voltage of −5 kV is at a distance 66.5 mm from the axis of the lens LE 11.

Electrostatic lens LE 13: identical to the LE 11 except that the central electrode is at a potential of −4310 volts. This electrode is situated at 36 mm from the center of the slotted lens LF 13 and at 30 mm from the inlet slot FE 20 situated downstream therefrom.

Mass spectrometer 2. Inlet slot FE 20: this is a rectangular aperture of 0.024×0.8 mm (with active post-acceleration), for a mass resolution $M/\Delta M=4{,}000$. Its long axis is perpendicular to the radial plane. The slot is adjustable in both the x and the y directions.

Post-acceleration electrode PA 21: a disk of thickness 8 mm having a hole of inside diameter 14 mm and isolated by an alumina cylinder. The disk is at +20 kV in post-acceleration operation and the downstream components thus have their reference potential raised to +15 kV.

The hexapole HP 22: six cylindrical bars of 8 mm diameter and 36 mm length with their axes regularly distributed over a cylindrical surface of 24 mm diameter. The potential difference between adjacent bars alternates between ±36 volts. The center of the hexapole is 52 mm downstream from the electrode PC 21 and 43 mm upstream from the inlet face of the electrostatic sector.

Electrostatic sector SE 23: deflection angle 90°. Two concentric portions of a sphere having radii of 94 mm and 106 mm. The potential difference applied between the inner and outer portion: +4,819.8 volts. Inlet and outlet guard slots to limit electric field leakage.

Hexapole HP 25: similar to HP 22, except that the bars are of length 72 mm and the potential differences are ±1,702.5 volts. Its center is 77 mm downstream from the outlet face from the electrostatic sector SE 23.

Quadrupole QP 26: four cylindrical bars having a diameter of 24 mm and a length of 120 mm with their axes regularly distributed about a cylindrical surface of 46 mm diameter. The potential differences are ±46.4 volts in alternation with the negative potential bars being situated in the radial plane.

Slotted lens LF 27: same general structure as LF 13; the central electrode has a 14×70 mm central hole, and the outer electrodes have respective 10×60 mm central holes. The central electrode is at a potential corresponding to a focal length of 173 mm and is placed 119 mm downstream from the center of the quadrupole QP 26.

Aperture slot FO 29: dimensions equal 5×0.7 mm for a mass resolution $M/\Delta M=4{,}100$; its long axis is the radial plane.

Magnetic sector SM 30: a magnetic circuit in the form of a U-section soft iron magnetic circuit. The magnet air gap is 8 mm. The useful trajectories are 70 to 350 mm in radius. The magnetic induction is adjustable up to 1 Tesla.

The angle of the inlet face $\epsilon=26°56$ ($\tan \epsilon=\frac{1}{2}$).

Deflection angle $\theta=90°$.

Angle of the outlet face $\theta/2=45°$.

Angle of the focal plane PF 35=53°13.

The magnetic circuit is at ground potential, but non-magnetic electrodes placed inside the air gap are at a potential of +15 kV in post-acceleration mode operation. Finally, a magnetic shunt limits field leakage at the inlet space to the magnetic sector. The upper portion of the focus plane PF 35 is placed in a multicollector assembly constituted by ion-to-electron converters followed by electron multipliers.

The optical components (other than the magnet) are placed in a stainless steel structure which provides the mechanical positioning of the various devices and which serves as a vacuum enclosure. A cryogenic pump serves to obtain the desired ultra-high vacuum. The magnet is connected to the above device by a resilient and vacuum-proof system which includes means for being mechanically aligned with the optical axes.

Figure 5A:
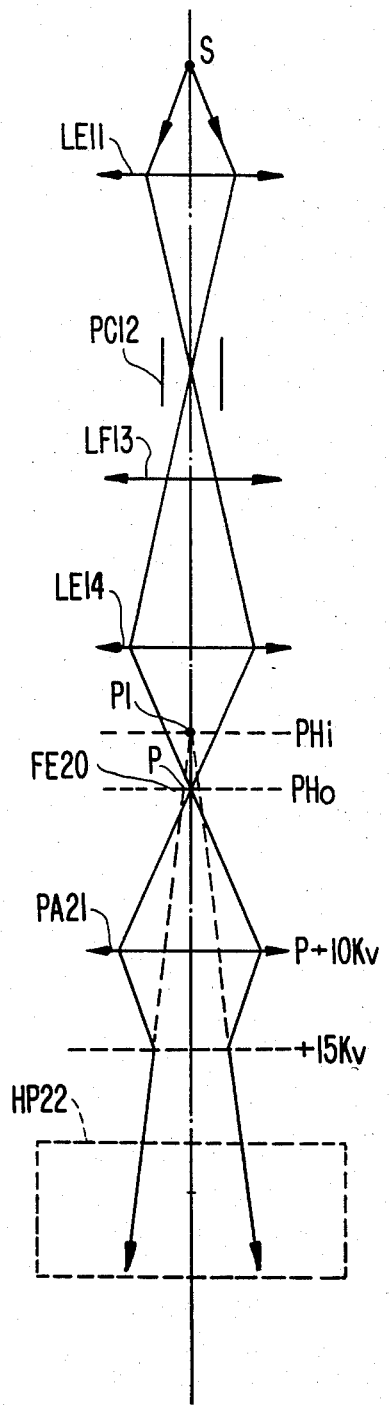
FIGS. 5A and 5B show the operation of this example with post-accelerating.
Figure 5B:
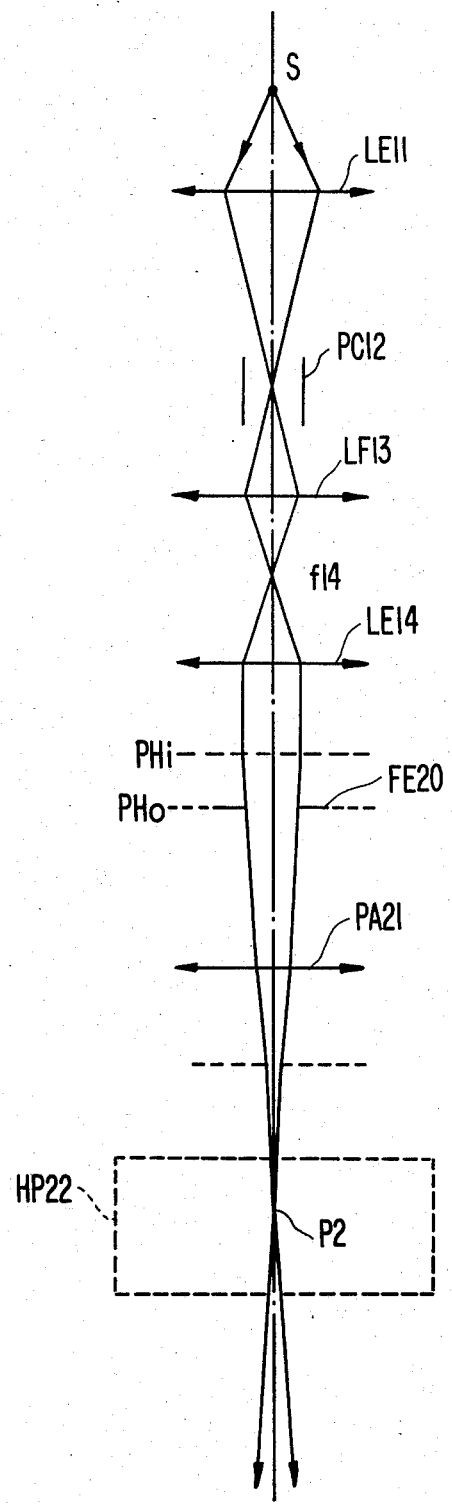
Figure 6A:
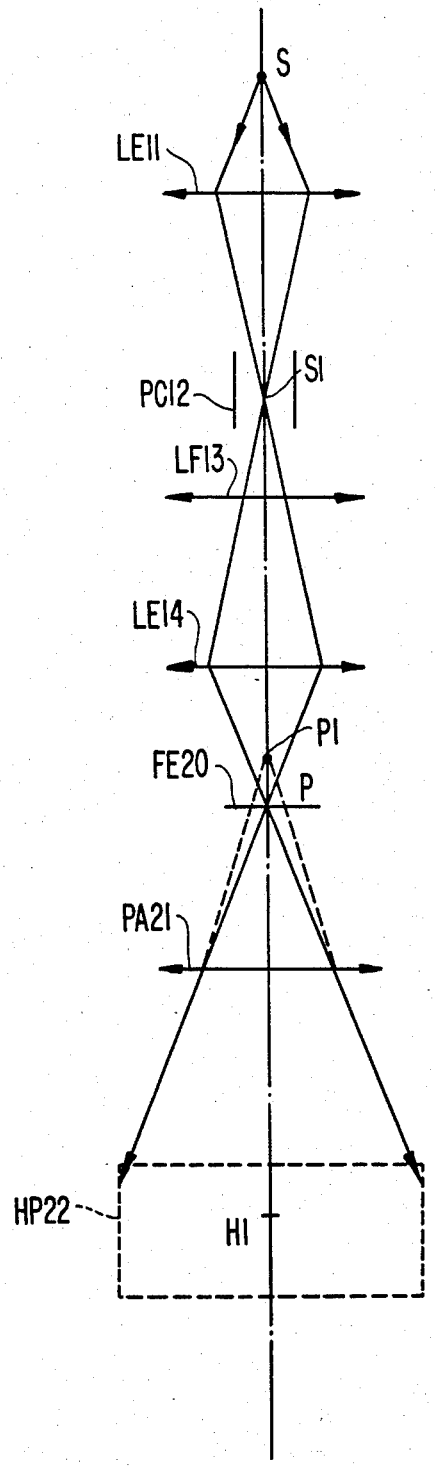
FIGS. 6A and 6B show the operation of the same example without post-acceleration.
Figure 6B:
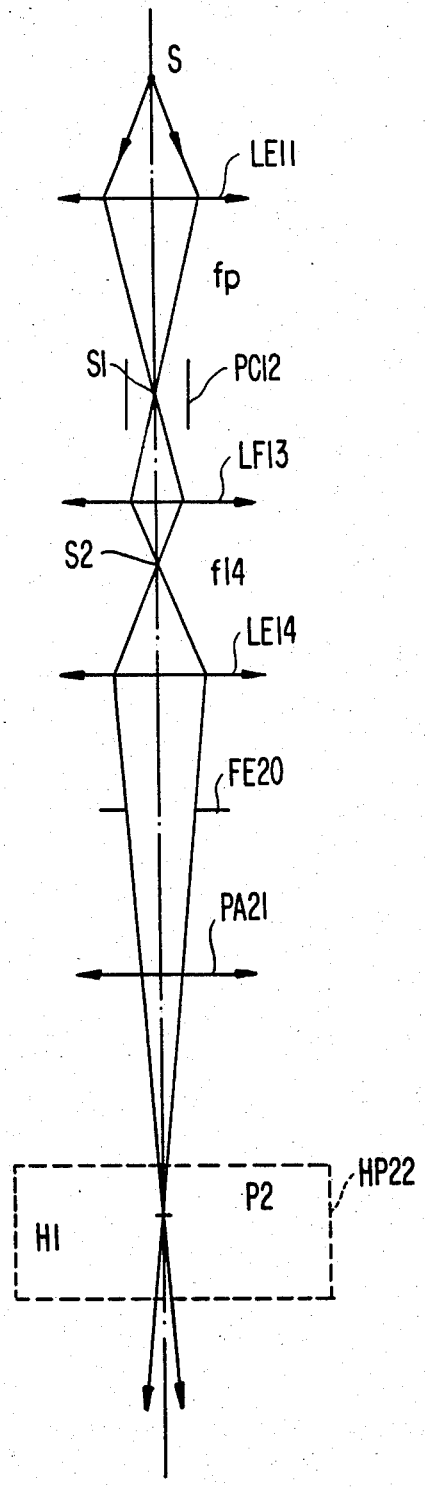

Reference is now made to FIGS. 5A and 5B, and to FIGS. 6A and 6B, to provide a better illustration of the operation with and without post-accelerating respectively.

Up to the slotted lens LF 13, the trajectories remain as described above and they are the same in the radial plane as in the vertical section.

FIG. 5A shows that in the radial plane the trajectories pass without alteration through the slotted lens LF 13 so as to encounter the second electrostatic lens LE 14 and to be focused, in theory, at the point P. However, the post-acceleration lens PA 21 at 10 kV produces a point of apparent focus at P1 for the remainder of the spectrometer downstream therefrom. The trajectories applied to the hexapole HP 22 thus stem from this point P1. For the numerical values given above, the distance between points P1 and P, or more exactly between the planes PHi and PHO is 11 mm.

In vertical section (FIG. 5B) the trajectories are modified by the slotted lens LF 13. They are thus parallel up to the plane PHi, after which they converge slightly to pass through the aperture slot FE 20 in the plane PHO and then take their final orientation towards the point of constriction P2 on which the hexapole HP 22 is centered.

The focal distances are as follows:

For the lens LE 22, f11=15 mm;

For the lens LF 13, f13=9.44 mm;

For the lens LE 14, f14=19.88 mm;

For the lens PA 21, f21=97 mm.

In operation and without post-acceleration (FIGS. 6A and 6B) the lens PA 21 produces only the effect of converging lens. The point P thus remains associated with a point P1, from which the trajectories found downstream from the lens PA 21 in the radial plane appear to start.

In vertical section (FIG. 6B) the adjustments of the transfer optics are modified so that the trajectories begin to converge on leaving the second electrostatic lens LE 14. They pass through the inlet slot FE 20 and converge a little more at the lens PA 21 to finally end up at the same constriction point P2 as before.

The values of the focal distances are slightly different:

f11 and f14 remain the same;

for the lens LF 13, f13=8.30 mm; and for the lens PA 21, f21=139.09 mm.

When unit magnification is obtained at the inlet slot in post-acceleration mode, the non post-acceleration mode provides a magnification of 1.32 between the image situated at P1 and the image situated at P.

It thus appears that post-acceleration, accompanied by the convergence effect related to the additional electrode PA 21 is compatible with the properties of independent adjustments possessed by the apparatus in accordance with the invention: only the electrical voltages need to be adjusted.

Naturally, some of the components of the spectrometer described in detail above could be replaced by equivalent components. The single quadrupole QP 26 could thus be replaced two quadrupoles. The person skilled in the art will be aware of other equivalents to the quadrupole, to hexapoles, to electrostatic lenses and to slotted lenses.

We claim:

1. A mass spectrometer, comprising:

inlet means for receiving a beam of charged particles having horizontal trajectory components in a radial plane and vertical trajectory components transverse to said radial plane;

first deflection means for impinging a first deflection, in the radial plane, to the beam of particles received from said inlet means, said first deflection varying with the velocity of the particles;

correcting means, arranged on the path of the particle beam, for compensating for second order aperture aberrations of said first deflection means for trajectories in the radial plane;

beam shaping means for independently adapting the horizontal and vertical trajectory components of the beam received from said first deflection means to provide a parallel beam having a thin vertical section transverse to said radial plane, and for passing the parallel beam through an aperture slot; and second deflection means for impinging a second deflection, in the radial plane, to the beam of particles received from said aperture slot, said second deflection varying with both the mass and energy of the particles, and the energy dependent component of the second deflection being substantially compensated for by said first deflection in the first deflection means, said second deflection means having a planar inlet face inclined by an angle $\epsilon$, with respect to a normal to the axis of the particle beam incident thereon, in the direction of the deflection in said second deflection means, and having a planar outlet face in a plane passing through the intersection of the inlet face and the axis of the particle beam, so that the following equation is satisfied $$\tan(\theta/2)\tan(\theta-\epsilon)=2,$$

where $\theta$ designates the angle of deflection of the beam in said second deflection means.

2. A spectrometer according to claim 1, wherein:

said first deflection means comprises an electrostatic sector; and said second deflection means comprises a magnetic sector.

3. A spectrometer according to claim 2, wherein:

said inlet means comprises an inlet slot; and said corresponding means comprises transfer optics means, upstream from the inlet slot, for providing, in combination with said inlet means, the particle beam with a constriction in a vertical direction, perpendicular to the radial plane, at a position within said inlet means located between the inlet slot and the electrostatic sector, and a first hexapole, provided at the constriction of the particle beam within said inlet means, arranged to compensate for second order aperture aberrations created by the electrostatic sector for trajectories in the radial plane without introducing aberrations of the same order by its action on the trajectories in the vertical section.

4. A spectrometer according to claim 3, wherein:

said transfer optics means is arranged to provide a particle beam which is substantially parallel in vertical section to the inlet slot;

said inlet means further comprises a converging lens positioned between the inlet slot and the first hexapole; and said first hexapole is centered on the conjugate point of the inlet slot by said converging lens in the vertical section of the beam.

5. A spectrometer according to claim 4, wherein said converging lens is also a post-acceleration lens, including at least one electrode for providing adjustable convergence.

6. A spectrometer according to claim 5, wherein said transfer optics means comprises:

two electrostatic lenses which provide the particle beam with a constriction in the radial plane at the inlet slot; and a slotted lens between said two electrostatic lenses to provide the particle beam with a substantially parallel vertical section at the inlet slot.

7. A spectrometer according to claim 3, wherein:

said electrostatic sector and the magnetic sector both have respective virtual chromatic rotation centers; and said beam shaping means comprises quadrupole means for conjugating the centers of chromatic rotation of the electrostatic and magnetic sector with appropriate magnification, thereby providing complete correction for the chromatic dispersion of the particle beam for a given mass, the correction for other masses being performed in the focal plane of the magnetic sector.

8. A spectrometer according to claim 7, wherein:

said quadrupole means is arranged in such a manner that its object focus coincides with the real image given by the electrostatic sector of the inlet slot in the radial plane; and said spectrometer further comprises means for compensating for the divergence in the vertical section caused by said quadrupole means so that the particle beam is substantially parallel in both of its transverse dimensions.

9. A spectrometer according to claim 8, wherein the means for compensating the divergence of the quadrupole in the vertical section comprises a slotted lens.

10. A spectrometer according to claim 3, wherein said beam shaping means comprises a second hexapole disposed after the electrostatic sector and centered on a real image of said inlet slot given by the electrostatic sector in the radial plane, thereby reducing combined aperture and chromatic aberrations for trajectories situated in the radial plane, with the compensation being exact for a chosen mass.

11. A spectrometer according to claim 10, wherein said second hexapole comprises two hexapoles positioned on either side of an energy filtering slot.

12. A spectrometer according to any one of claims 1 to 11, wherein $\theta=90°$ and $\tan \epsilon=\frac{1}{2}$.

* * * * *